United States Patent [19]

Beamer et al.

[11] 4,161,286

[45] Jul. 17, 1979

[54] SELF-COMPENSATING NOZZLE CONSTRUCTION

[75] Inventors: John D. Beamer, West Covina; William J. Wichman, Glendora, both of Calif.

[73] Assignee: Rain Bird Sprinkler Manufacturing Corporation, Glendora, Calif.

[21] Appl. No.: 844,659

[22] Filed: Oct. 25, 1977

[51] Int. Cl.[2] ..... B05B 3/14

[52] U.S. Cl. ..... 239/230; 239/391

[58] Field of Search ..... 239/230, 233, 390, 391

[56] References Cited

U.S. PATENT DOCUMENTS

| | | | |
|---|---|---|---|
| 2,778,681 | 1/1957 | Dudley | 239/230 |
| 3,623,666 | 11/1971 | Meyer | 239/230 |

*Primary Examiner*—Robert W. Saifer

*Attorney, Agent, or Firm*—Fulwider, Patton

[57] ABSTRACT

An improved water sprinkler of the arm driven type which has a reverse drive arm movable into the water stream emerging from a replaceable nozzle, to provide rapid reverse rotation of the sprinkler. The improvement lies in a novel nozzle structure which limits movement of the reverse drive arm by an amount dependent upon the nozzle size, thereby resulting in substantially the same reversing force regardless of nozzle size.

3 Claims, 4 Drawing Figures

Fig. 1
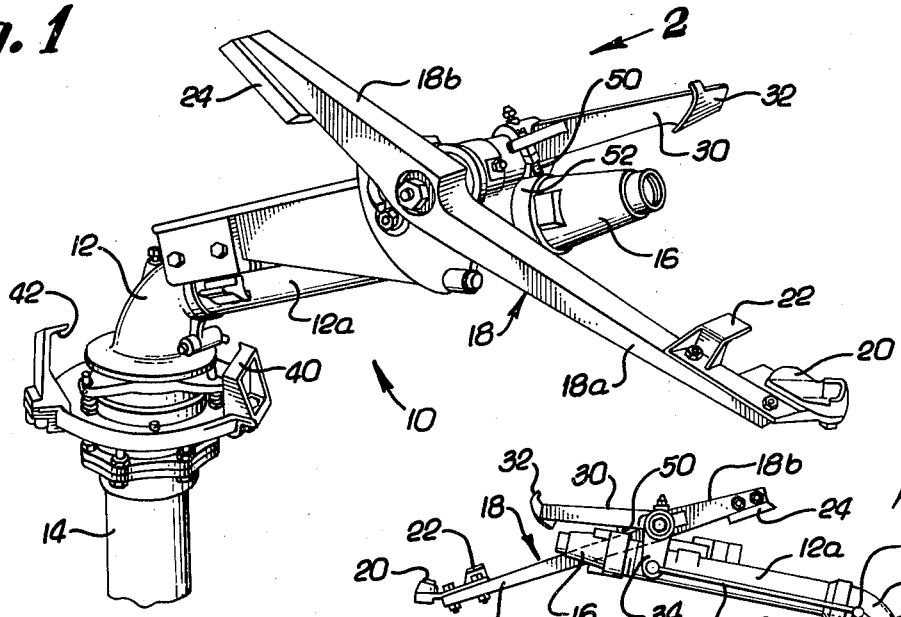
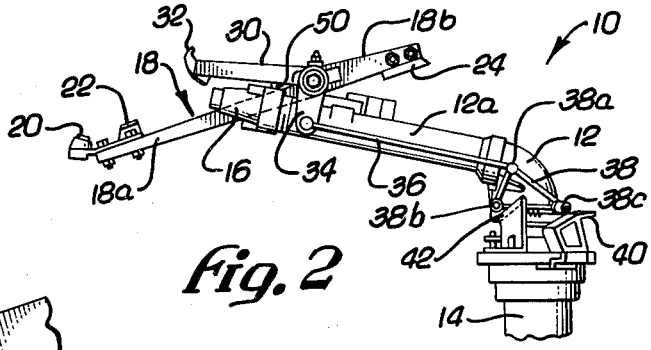
Fig. 2
Fig. 3
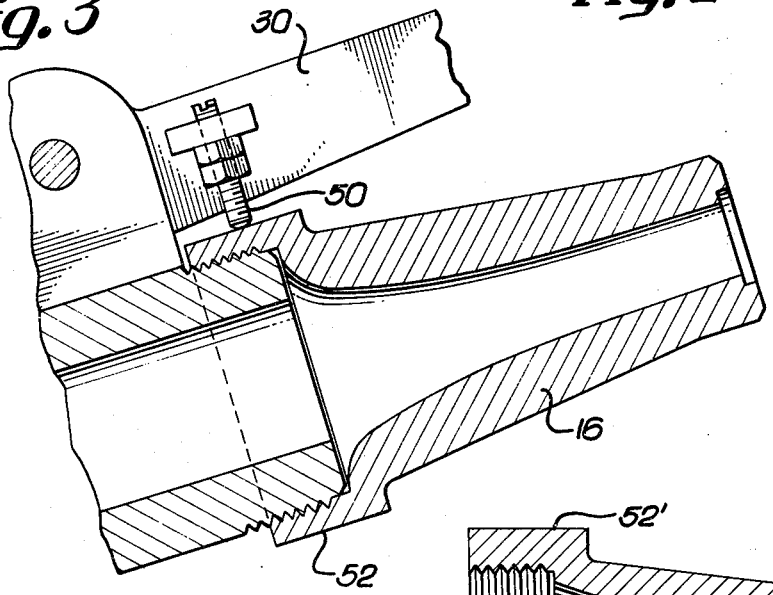
Fig. 4
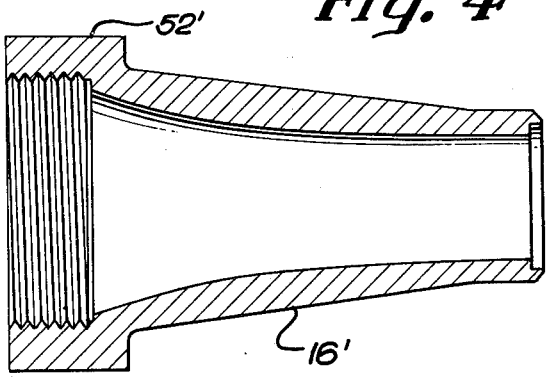

SELF-COMPENSATING NOZZLE CONSTRUCTION

BACKGROUND OF THE INVENTION

This invention relates generally to irrigation water sprinklers of the arm driven type suitable for mounting on a center pivot, and, more particularly, relates to relatively large sprinklers of this type which include a reversing mechanism for part-circle watering.

Sprinklers of this type have a sprinkler body mounted for rotation on a substantially vertical axis, to receive water supplied through a vertical riser type, a removable sprinkler nozzle attached to the sprinkler body to direct a stream of water outwardly from the sprinkler at an angle of about 10°-30° above the horizontal, an oscillating forward drive arm, and a reversing drive arm. Unlike smaller impact arm sprinklers, which typically utilize a torsional spring to urge an impact arm into the stream of water, sprinklers of the type with which this invention is concerned usually have a forward drive arm mounted for rotation about a horizontal axis near the nozzle. The forward drive arm has a deflector spoon at one end, and a counterweight at the other end to urge the spoon into the stream of water.

When the stream of water impinges on the deflector spoon, reaction forces operate to pivot the forward drive arm about its axis of rotation, and to apply an increment of angular movement to the entire sprinkler. When the sprinkler has been rotated through a preselected arc, a camming mechanism operates to rotate the reverse drive arm, and to move a reverse deflector spoon into the stream of water, thereby rapidly rotating the sprinkler in a reverse direction back to its starting point. One sprinkler of the foregoing general type is the Model 103 Rain Gun manufactured by Rain Bird Sprinkler Mfg. Corporation, of Glendora, California.

One difficulty in operating sprinklers of this type arises from the desirability of employing nozzles of various sizes for various irrigation applications. When a relatively large-diameter nozzle is used, the reverse drive arm moves the sprinkler in a reverse direction with a very large accelerating force. The reverse movement can be so rapid that there is a significant risk of injury to anyone standing nearby, as well as a likelihood of increased wear and possible damage to the sprinkler itself. Of course, movement of the reverse drive arm can be adjusted to allow a smaller portion of the reverse deflector spoon to enter the water stream, thereby reducing the reverse accelerating force and obviating the problem. However, when a nozzle of different size is again installed, readjustment is always necessary.

It will therefore be appreciated that there has long been a need for an improved sprinkler of the foregoing general type which includes some means associated with its reversing mechanism for automatically compensating for nozzles of different sizes. The present invention satisfies this need.

SUMMARY OF THE INVENTION

The present invention resides in a sprinkler having a reversing spoon of which the operative position is determined automatically by the size of the installed nozzle. The improvement of the present invention is embodied in a sprinkler which includes a sprinkler body, a removable nozzle attached thereto, an oscillating forward drive arm for forward movement of the sprinkler, and a reverse drive arm having a reverse deflector spoon attached to its end, and being mounted for pivotal movement to move the reverse deflector spoon into an operative position in the stream of water emerging from the nozzle. The improvement comprises means which are in part integral with the nozzle, for determining the exact operative position of the reverse deflector spoon with respect to the water stream. More specifically, the means for determining the operative position includes first means attached to the reverse drive arm and second means integral with the nozzle, the second means being positioned to abut the first means on movement of the reverse drive arm toward the operative position, and the second means being dependent upon the size of the nozzle, so that a larger nozzle will limit movement of the reverse deflector spoon into the water stream more than a smaller nozzle will.

In the presently preferred embodiment of the invention, the first means includes an adjustable stop screw projecting from the reverse impact arm, and the second means includes a collar integral with the nozzle, the adjustable stop screw being located so as to abut the collar and therefore determine the precise operative position of the reverse deflector spoon. The outer diameter of the nozzle collar is dependent upon the nozzle size, and the operative position of the reverse deflector spoon is such that a relatively uniform accelerating force is applied to the sprinkler regardless of nozzle size.

It will be appreciated from the foregoing summary that the present invention represents a significant advance in the field of reversable sprinklers of the aforedescribed type. The invention provides an improved reversing mechanism with an acceleration in the reverse direction, which is independent of nozzle size. Other aspects and advantages of the present invention will become apparent from the following more detailed description taken in conjunction with the accompanying drawings.

BRIEF DESCRIPTION OF THE DRAWINGS

FIG. 1 is a perspective view of a sprinkler embodying the improvement of the present invention;

FIG. 2 is an elevational view taken in the direction of the arrow 2 in FIG. 1, and shown at a scale reduced from that of FIG. 1;

FIG. 3 is an enlarged fragmentary view, partly in section, showing relevant detail of the nozzle and reverse drive arm construction; and FIG. 4 is a sectional view of a nozzle of larger diameter than that shown in FIG. 3.

DETAILED DESCRIPTION

As shown in the drawings for purposes of illustration, the present invention is concerned with an improvement in large water sprinklers of the arm driven type having a reversing mechanism for part-circle watering. As shown in FIG. 1, a sprinkler of this type, indicated by reference numeral 10, includes a sprinkler body 12 mounted for rotation about a substantially vertical axis on a riser pipe 14 which supplies water to the sprinkler. The sprinkler body 12 includes a cylindrical portion **12*a* inclined at an angle of approximately 10°-30° to the horizontal, through which water is passed to a removable nozzle 16 attached to the end of the cylindrical portion. A forward drive arm 18 is mounted for pivotal movement about a horizontal axis located near the nozzle 16. The forward drive arm 18 has a deflector spoon 20 and a vane 22 mounted at the end of a lower portion 18*a* of the arm. An upper portion 18*b* of the arm, extending in a diametrically opposite direction from the lower portion 18***a*, has a counterweight 24 attached to its end. The mass of the counterweight 24 is such that the deflector spoon 20 is urged upwardly into the stream of water which emerges from the nozzle 16. Reaction forces acting on the deflector spoon 20 cause it to pivot away from the stream and simultaneously apply an angular increment of acceleration to the entire sprinkler 10. The counterweight 24 then operates to move the deflector spoon 20 back into the stream and apply another increment of acceleration to the sprinkler. The forward drive arm 18 oscillates in this manner to move the sprinkler angularly in a forward direction across a desired arc.

Also mounted for rotation about a horizontal axis is a reverse drive arm 30, which extends forwardly above and generally parallel with the nozzle 16, and has a reverse deflector spoon 32 attached to its end. When the reverse deflector spoon 32 is lowered into the stream of water emerging from the nozzle 16, reaction forces acting on the reverse deflector spoon rapidly rotate the sprinkler in a reverse direction to its starting point.

The means for moving the reverse impact arm 30 do not form part of the present invention and will be only briefly described. Mounted for rotation with the reverse drive arm 30 is a downwardly depending crank 34, at the end of which is connected a rod 36 which extends along the cylindrical portion 12*a* of the sprinkler body 12. The rod 36 is pivotally attached at its other end to the upper corner 38*a* of a rigid triangular structure 38. A lower corner 38*b* of the structure is pivotally mounted to the sprinkler body 12, in the other lower corner 38*c* is movable by camming surfaces 40 and 42, as will be described. It will be seen that, upon upward movement of the corner 38*c* and counter-clockwise rotation of the triangular structure 38, the rod 36 will be moved outwardly toward the nozzle 16, thereby rotating the crank 34 in a clockwise direction and raising the reverse drive arm 30. Likewise, when the corner 38*c* is lowered, the triangular structure 38 is rotated in a clockwise direction, the rod 36 is moved away from the nozzle, and the crank 34 is rotated in a counterclockwise direction, lowering the reverse drive arm. It will also be seen from FIG. 2 that, when the corner 38*c*, on which is mounted a roller, approaches the camming surface 42, it will be lowered by camming action, and when it approaches the camming surface 40 it will be raised. Thus, by appropriately positioning the camming surfaces 40 and 42, an appropriate operating arc for the sprinkler can be defined.

In accordance with the invention, movement of the reverse drive arm 30 is controlled in part by the size of the nozzle 16 attached to the cylindrical portion 12*a* of the sprinkler body 12. Movement of the reverse drive arm 30 in a downward direction is limited by abutment of an adjustable stop screw 50 against a collar 52 integral with the nozzle 16. Thus, the position of the stop screw 50 and the diameter of the collar 52 together determine the exact position of the reverse deflector spoon 32 in the stream of water emerging from the nozzle 16. When a nozzle of larger diameter is employed, such as the one designated by 16' in FIG. 4, the collar diameter 52' is larger than the collar diameter 52 of the nozzle 16. Therefore, as long as the stop screw 50 is not readjusted, the reverse deflector spoon 32 will not travel as far toward the center of the water stream. The diameters 52 and 52' are selected such that the reaction forces acting on the reverse deflector spoon are substantially constant regardless of nozzle size.

It will be appreciated from the foregoing description that the present invention provides a significant advantage over prior sprinklers of this type, since the reversing mechanism requires no readjustment for changes in nozzle size. It will also be appreciated that, although a specific embodiment of the invention has been described in detail for purposes of illustration, various modifications may be made without departing from the spirit and scope of the invention. Accordingly, the invention is not to be limited except as by the appended claims.

We claim:

1. In a part-circle water sprinkler having a sprinkler body, a replaceable nozzle from which a continuous stream of water is ejected, a forward drive arm to provide incremental angular movement in a forward direction, and a reverse drive arm movable into the water stream to provide a reverse movement, the improvement comprising:

first means, located on said nozzle, to limit the extent of movement of said reverse drive arm into the water stream, to a degree dependent upon the nozzle size; and second means, located on said reverse drive arm, to abut said first means and thereby determine the extent to which said reverse drive arm is moved into the water stream, whereby larger or smaller nozzle sizes and correspondingly larger or smaller stream diameters will not substantially affect the acceleration force provided by said reverse drive arm.

2. The improvement as set forth in claim 1, wherein said first means includes an external collar portion of said nozzle, the diameter of said collar portion being dependent upon the internal bore of said nozzle.

3. The improvement as set forth in claim 2, wherein said second means includes an adjustable stop screw, positioned to abut said collar portion and thereby limit movement of said reverse drive arm to an extent dependent upon the bore of said nozzle.

* * * * *